United States Patent [19]

Wallis

[11] 4,316,399

[45] Feb. 23, 1982

[54] COMBINED PUNCH RETAINER AND FLUID ACTUATED STRIPPER

[76] Inventor: Bernard J. Wallis, 25200 Trowbridge Ave., Dearborn, Mich. 48124

[21] Appl. No.: 137,371

[22] Filed: Apr. 4, 1980

[51] Int. Cl.[3] ..... B26D 7/06

[52] U.S. Cl. ..... 83/137; 83/138

[58] Field of Search ..... 83/137, 138

[56] References Cited

U.S. PATENT DOCUMENTS

| | | | |
|---|---|---|---|
| 2,230,043 | 1/1941 | Moran | 83/138 |
| 2,579,940 | 12/1951 | Lobrovich | 83/137 X |
| 2,983,176 | 5/1961 | Taylor | 83/138 |
| 4,048,889 | 9/1977 | Finley | 83/138 |

*Primary Examiner*—Donald R. Schran

*Attorney, Agent, or Firm*—Barnes, Kisselle, Raisch & Choate

[57] ABSTRACT

A punch retainer is formed with a bore in its upper portion for releasably securing a punch therein. The lower portion of the punch retainer is formed as a cylinder for a vertically movable stripper piston. The portion of the cylinder above the piston is connected to a source of gas under pressure so as to bias the piston downwardly. The punch extends downwardly in sealed relation through a central bore in the piston and terminates slightly above the lower end of the piston when the piston is in its lowermost position.

8 Claims, 5 Drawing Figures

COMBINED PUNCH RETAINER AND FLUID ACTUATED STRIPPER

This invention relates to a combined punch retainer and fluid actuated stripper.

It is an object of this invention to provide a combined punch retainer and stripper which is of relatively small size and, nevertheless, capable of exerting very high forces.

Another object of this invention is to provide a combined punch retainer and fluid actuated stripper of economical design and which is readily servicable.

A further object of this invention is to provide a device of the type described which enables the punch to be removed without removing the stripper and also permits the removal of the stripper without removing the punch.

Other objects, features and advantages of the present invention will become apparent from the following description and accompanying drawings, in which.

Figure 1:
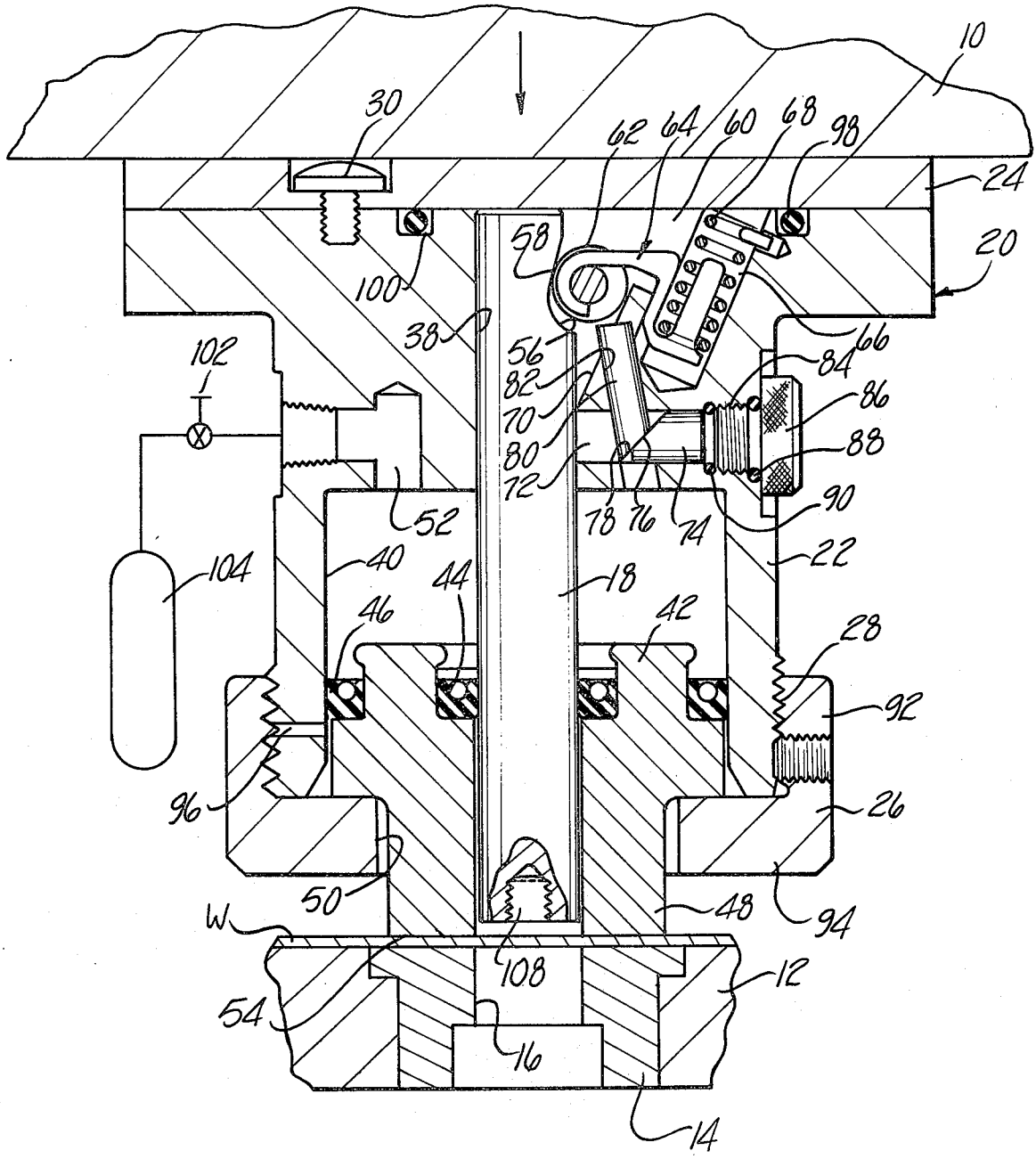
FIG. 1 is a vertical sectional view through a combined punch retainer and fluid actuated stripper of the present invention showing the components just before the punch penetrates through a workpiece.

Referring to FIG. 1, a conventional die arrangement is illustrated wherein the upper die member is designated 10 and the lower die member is designated 12. The upper die member 10 is reciprocated vertically toward and away from the lower die member 12. Within the lower die member 12 there is arranged a die bushing 14 which is centrally apertured as at 16 for cooperation with an associated punch 18. Punch 18 is adapted to be removably mounted within a punch retainer, generally designated 20. Punch retainer 20 comprises a central body portion 22 having a cover plate 24 at its upper end and a cap 26 threaded over the lower end thereof as at 28. Cover plate 24 is secured to the body portion 22 by a plurality of screws 30 and the entire retainer assembly is adapted to be secured to the upper die member 10 by means of screws extending upwardly through apertures 32 (FIG. 3) in the peripheral flange portion 34 of the body member 22. If desired, flange portion 34 can also be provided with additional apertures 36 for dowel pins to enable precise alignment of the punch and die.

Body member 22 is provided with a vertically extending central bore 38 for receiving the shank of punch 18 with a close fit. Below the bore 38 body member 22 is formed with a cylinder bore 40 in which a piston 42 is arranged for vertical reciprocation. Adjacent its upper end piston 42 is provided with inner and outer annular seals 44,46 to seal the piston with respect to punch 18 and cylinder bore 40. The reduced lower end portion 48 of piston 42 extends downwardly through the central aperture 50 in the cap 26 at the lower end of body member 22. The portion of cylinder bore 40 above piston 42 is adapted to be connected with a source of gas, such as nitrogen, at a desired high pressure by means of a passageway 52. When the upper die member 10 is raised and the upper portion of cylinder bore 40 is pressurized, piston 42 is urged downwardly to its lowermost position where the bottom side of the piston engages the end wall of cap 26 and the lower end 54 of the reduced end portion 48 of the piston is disposed at a level below the lower end of cap 26.

The upper end portion of punch 18 is formed with a recess 56 at one side thereof. Recess 56 has a flat face 58 extending upwardly at a small acute angle to the axis of the punch. At one side of the punch bore 38 the body member 22 is provided at its upper end with a cavity 60 in which a mechanism for releasably retaining the punch in the retainer is housed. This mechanism comprises a cylindrical roller 62 supported by a retainer 64 which is slidable in a cylindrical portion 66 of cavity 60. Retainer 64 is biased in a downwardly direction by a spring 68. Cavity 60 also has a downwardly inclined flat face 70 adapted to be engaged by roller 62. The flat face 58 on punch 18 and the flat face 70 in cavity 60 converge toward each other in a downwardly direction to form wedge gripping surfaces for roller 58. Thus, in the position shown in FIG. 1, roller 62 is biased downwardly by spring 68 so as to provide a wedge between surfaces 58 and 70 and, thereby, prevent displacement of punch 18 downwardly relative to the punch retainer 20. Cover plate 24 prevents upward displacement of punch 18 in the retainer.

Retainer body 22 is formed with a bore 72 extending radially upwardly to the punch bore 38. Within bore 72 there is arranged a plunger 74 having a cam end face 76 engaged with a correspondingly inclined face 78 at the lower end of a plunger 80 which is vertically slidable in a bore 82. The upper end of plunger 80 is normally spaced slightly below roller 62 when the latter is wedged between punch 18 and surface 70. The outer end of bore 72 is threaded as at 84 to receive a plug 86. Plug 86 is sealed with respect to bore 72 by an O-ring 88. Plunger 74 is prevented from being withdrawn from bore 72 by a snap ring 90.

Cap 26 has a side wall 92 and a bottom wall 94. The bottom wall 94 extends radially inwardly beyond the cylinder bore 40 so as to present a shoulder around central opening 50 which limits the extent of downward movement of stripper piston 42 relative to the cylinder. The wall of retainer body 22 which surrounds the cylinder bore 40 is provided with a radial passageway 96 therein which is located at least slightly below seal 46 when the piston 42 is in its lowermost position. Thus, under normal conditions seal 46 prevents the escape of gas from the cylinder through passageway 96 and the threaded connection between cap 92 and the cylinder.

Figure 2:
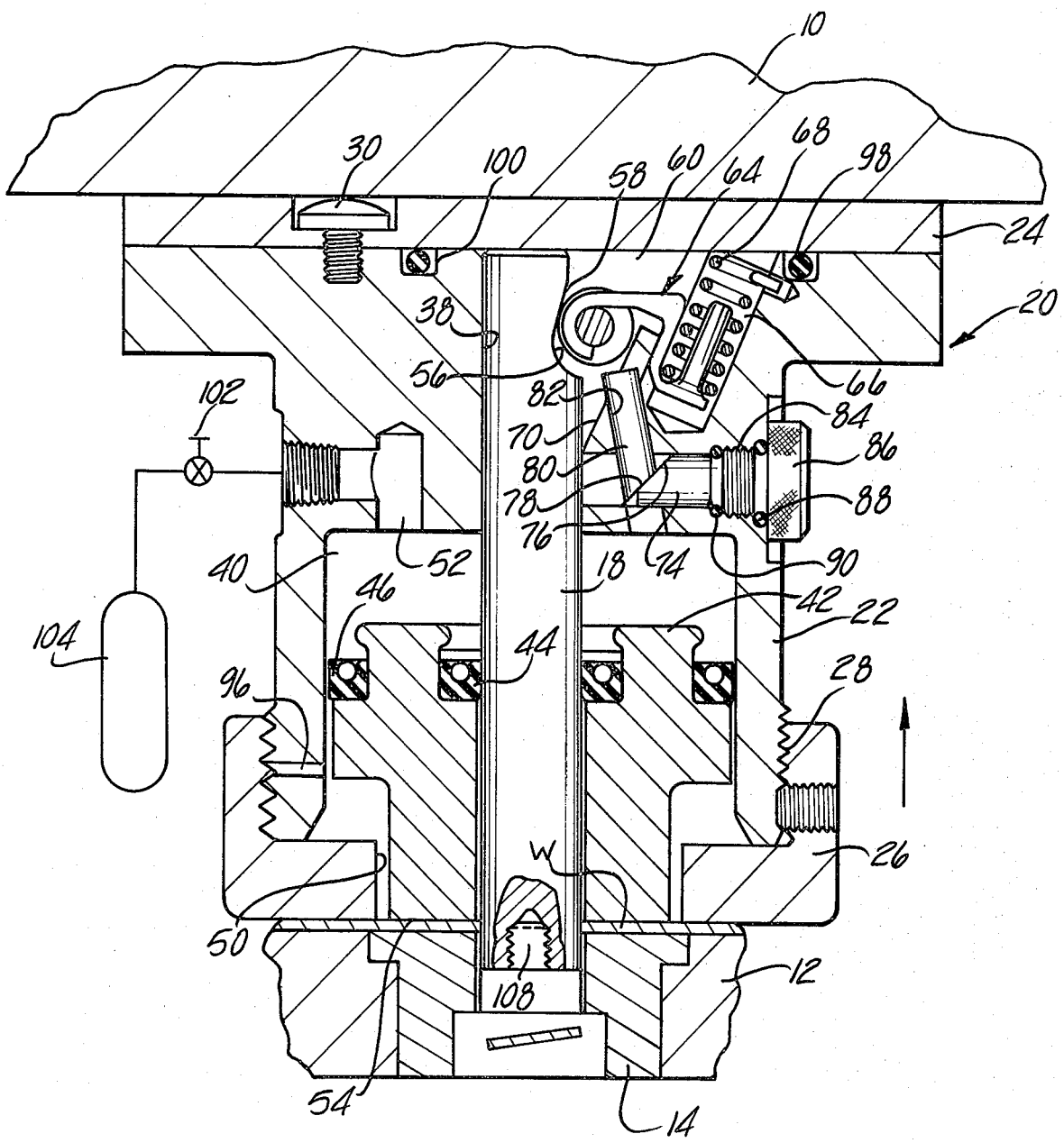
FIG. 2 is a view similar to FIG. 1 and showing the components just after the punch penetrates through a workpiece.

In operation, as the upper die member descends and approaches the lower end of its stroke, the bottom end face 54 of the piston engages the workpiece W on the lower die member 12 and holds it firmly in place. This is the condition shown in FIG. 1. In this position the lower end of the punch is still spaced upwardly above the workpiece. As the upper die member descends further, the pressure of the gas in cylinder bore 40 will retain the piston with the desired degree of pressure against the workpiece while the punch and its retainer continue to move downwardly. Eventually the punch penetrates through the workpiece W as shown in FIG. 2 and, thereafter, the upper die member will move upwardly to retract the punch while piston 42 is still biased downwardly against the workpiece. Thus, the punch 18 is stripped from the workpiece while the workpiece is being rigidly held in position.

Since the cavity 60 communicates with the cylinder bore 40 through the punch bore 38 and through bores 72,82, it follows that the cavity 60 and its associated bores must be effectively sealed from the exterior atmosphere. This is accomplished by an O-ring 98 that extends circumferentially around cavity 60 and the upper end of punch bore 38. O-ring 98 is seated in a circular groove 100 formed in the top face of retainer body 22 and, thus, provides an effective seal when cover 24 is secured to the upper end of retainer body 22.

When it is desired to service the stripper of the punch the first step consists in progressively threading the cap 26 in a direction so as to remove it from the retainer body 22. At this time the valve 102 which connects the cylinder bore 40 with the pressurized accumulator 104 is closed. However, the top side of piston 42 is still subjected to the accumulator pressure and must be relieved before cap 26 is removed. As soon as cap 26 is moved progressively downwardly on the retainer body 22, piston 42 and the seals thereon will likewise move downwardly. Eventually, passageway 96 will communicate with the portion of the cylinder bore 40 above seal 46 and, thus, permit the pressure above the piston to progressively and safely reduce to atmospheric either by way of direct communication with the surrounding atmosphere or by gradual leakage through the threaded connection at 28. After this pressure has been reduced to a safe value, the cap 26 can be completely removed from the lower end of the retainer with safety. Passageway 96 is located on the retainer body 22 so that cap 26 still has a substantial threaded connection with the retainer body by the time the pressure above piston 42 has been reduced to atmospheric.

Figure 3:
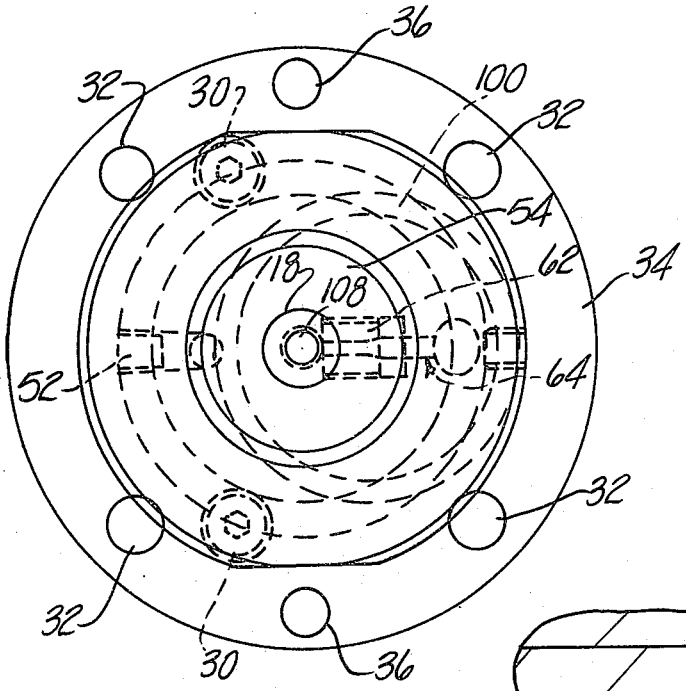
FIG. 3 is a bottom plan view of the combined punch retainer and stripper.
Figure 4:
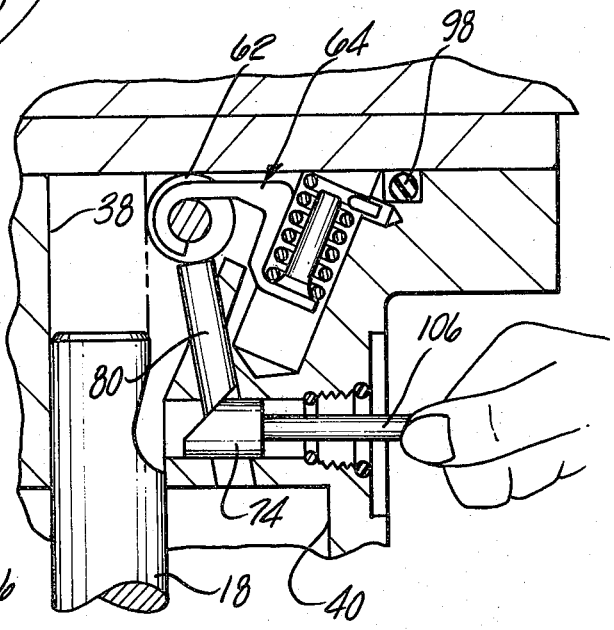
FIG. 4 is a fragmentary sectional view showing the manner in which the punch may be removed from the punch retainer.
Figure 5:
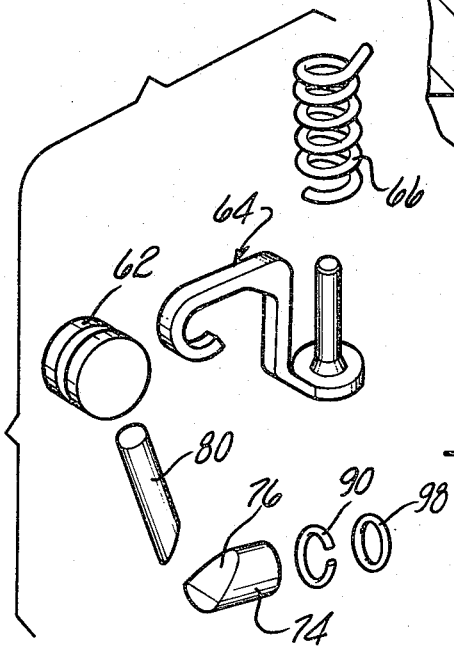
FIG. 5 is an exploded view illustrating the components of the mechanism for releasably retaining the punch in the retainer.

After the pressure above piston 42 has been reduced to atmospheric, the punch 18 can be readily retracted from the retainer by first removing plug 88 so as to render plunger 74 accessible. Then, as shown in FIG. 3, a suitable tool (such as a pin 106) is inserted into bore 72 to displace punger 74 inwardly and, thus, cause plunger 80 to be displaced upwardly. As plunger 80 is displaced upwardly it contacts roller 58 and compresses spring 68. Roller 62 is thus shifted upwardly and in a direction away from the inclined surface 58 on the punch. When the roller has been displaced sufficiently to clear the upper end of the punch, a suitable tool (not shown) is engaged with the threaded aperture 108 at the lower end of the punch to enable the punch to be fully withdrawn from within the retainer.

I claim:

1. A combined punch retainer and fluid actuated stripper comprising, a retainer body adapted to be mounted on a reciprocable die member, said body having an upper end and a lower end, a central vertical bore in said body extending to the upper end thereof and adapted to receive a punch, said body having a large cylindrical bore concentric with the punch bore and extending to the lower end of the body, a punch retained in said punch bore and extending downwardly to below the lower end of said body, a piston in said cylinder bore and surrounding said punch in sealed relation with the punch and the cylinder bore, said piston being movable vertically in said cylinder bore, means limiting movement of said piston in a downward direction to a position wherein the lower end of the piston is disposed below the lower end of said punch and in an upward direction to a position wherein the lower end of the piston is spaced at least slightly above the lower end of said body, means for directing a high pressure gas into the portion of the cylinder above said piston, said body having a cavity at the upper end thereof adjacent and communicating with said punch bore, a cover plate on said body closing the upper ends of said cavity and the punch bore, a seal between the cover plate and the upper end of said body, said seal extending around said cavity and punch bore to prevent the escape of gas therefrom and means in said cavity for releasably retaining the punch in said punch bore.

2. The combination called for in claim 1 including a passageway in said body extending from the exterior thereof and in communication with said cavity, said passageway being adapted to receive a tool for actuating said releasable punch retaining means and a removable plug sealing the outer end of said passageway.

3. The combination called for in claim 2 wherein said passageway is located vertically between the lower end of said cavity and the upper end of said cylinder bore.

4. The combination called for in claim 3 wherein said punch is formed with a recess at one side thereof facing said cavity, said retaining means comprising a detent resiliently biased into engagement with said recess to retain the punch in said bore and means in said passageway for displacing the detent out of engagement with the recess in the punch.

5. The combination called for in claim 2 wherein the punch is provided with a threaded socket at the lower end thereof adapted to be engaged by a threaded tool to permit withdrawal of the punch from the punch bore when the retaining means release the punch.

6. A combined punch retainer and fluid actuated stripper comprising, a retainer body adapted to be mounted on a reciprocable die member, said body having an upper end and a lower end, a central vertical bore in said body extending to the upper end thereof and adapted to receive a punch, said body having a large cylindrical bore concentric with the punch bore and extending to the lower end of the body, a punch retained in said punch bore and extending downwardly to below the lower end of said body, a piston in said cylinder bore and surrounding said punch in sealed relation with the punch and the cylinder bore, said piston being movable vertically in said cylinder bore, means limiting movement of said piston in a downward direction to a position wherein the lower end of the piston is disposed below the lower end of said punch and in an upward direction to a position wherein the lower end of the piston is spaced at least slightly above the lower end of said body, means for directing a high pressure gas into the portion of the cylinder above said piston, a centrally apertured cap threaded on the lower end of said body, said piston having a reduced end portion extending downwardly through the central opening in the cap, said cap being threaded around the outer periphery of said body, the threaded portion of said body having a radially extending aperture therein communicating with said cylinder bore, said aperture being positioned to permit the escape of gas from the cylinder bore before the cap is completely threaded off the lower end of the body.

7. The combination called for in claim 6 wherein said cap, when fully threaded on the lower end of said body, overlies said aperture and comprises said means for limiting downward movement of the piston to said position wherein its lower end is disposed below the lower end of the punch.

8. The combination called for in claim 7 wherein the piston is sealed in the cylinder bore by an annular seal on said piston, said seal being disposed above said aperture when the cap is fully threaded on the lower end of said body, said seal moving downwardly with said piston, past said aperture as the cap is threaded downwardly in a direction off said body.

* * * * *